United States Patent [19]

Simeth et al.

[11] Patent Number: 4,565,129

[45] Date of Patent: Jan. 21, 1986

[54] DEVICE FOR THE AUTOMATIC PILE CHANGE AT THE DELIVERY OF A PRINTING

[75] Inventors: Claus Simeth, Muhlheim; Janko Despot, Offenbach am Main, both of Fed. Rep. of Germany

[73] Assignee: Roland Offsetmaschinenfabrik Faber & Schleicher AG, Fed. Rep. of Germany

[21] Appl. No.: 192,246

[22] Filed: Sep. 30, 1980

Related U.S. Application Data

[63] Continuation of Ser. No. 954,581, Oct. 25, 1978, abandoned, which is a continuation-in-part of Ser. No. 889,651, Mar. 24, 1978, abandoned.

[51] Int. Cl.[4] ..... B41F 13/64; B65H 29/04

[52] U.S. Cl. ..... 101/240; 271/218; 414/43; 414/45; 414/101

[58] Field of Search ..... 101/132, 136, 232–240; 271/213, 206, 217–219; 414/43, 45, 50, 101, 265, 352, 486, 546, 550

[56] References Cited

U.S. PATENT DOCUMENTS

| | | | |
|---|---|---|---|
| 3,381,828 | 5/1968 | Sheehan | 414/101 |
| 3,718,267 | 2/1973 | Hiebert | 414/101 |
| 3,907,274 | 9/1975 | D'Amato | 101/232 |
| 4,111,411 | 9/1978 | Graves | 414/50 |

FOREIGN PATENT DOCUMENTS

| | | | |
|---|---|---|---|
| 2708927 | 11/1977 | Fed. Rep. of Germany | 101/240 |

*Primary Examiner*—A. J. Heinz

*Attorney, Agent, or Firm*—Leydig, Voit & Mayer Ltd.

[57] ABSTRACT

A pile changing device for a printing press delivery mechanism which includes a first conveyor for delivering sheets from the press seriatim to a piling space, the sheets being accumulated on a pile board in the form of a skid. A track extends from the piling space to a second conveyor. A fork lift mechanism is provided having a carriage which is shiftable on the track. Control means, which is automatically triggered when the skid becomes full, causes the fork lift mechanism to remove the skid from the piling space and to deposit it on the second conveyor. Upon removal of the full skid from the piling space the control means causes feeding of an empty skid via a third conveyor from a skid magazine into a precise sheet-receiving position. an auxiliary pile board is interposed on the path of the delivered sheets during the brief interval when there is no skid in sheet-receiving position. In the preferred embodiment of the invention the fork, in addition to its shifting movement, undergoes lifting, lowering and rotational movement in effecting transfer of the full skid.

1 Claim, 9 Drawing Figures

AUX. PILE BOARD ACTUATOR
IN
OUT

DEVICE FOR THE AUTOMATIC PILE CHANGE AT THE DELIVERY OF A PRINTING

This is a continuation of application Ser. No. 954,581, filed Oct. 25, 1978, now abandoned, which is a continuation-in-part of Application Ser. No. 889,651, filed Mar. 24, 1978, (abandoned).

Constant efforts have been made over the years to increase the printing speed of sheet fed presses. However, somewhat overlooked is the fact that the true printing rate is the number of copies produced per unit time, the time including that required to perform technically necessary operations such as the removal of a full pile at the delivery and replacement by an empty pile board. Pile change generally requires shut-down of the press. Even where the press is, through special techniques, including use of an auxiliary pile board, kept running during the pile change, it is necessary to reduce the speed of the press, particularly if one does not want the problem of disposing of numerous intercepted sheets.

Not only does the changing of the pile result in lost press production but it also makes a serious demand upon the attention and energies of a pressman. The progress of the pile must be constantly watched and the pressman must act quickly when the moment arrives to remove the full pile board, replacing it, as promptly as may be possible, with an empty board so that normal printing may resume. A pile change, being a critical operation requires full exercise of skill and experience and involves a certain amount of tension and strain.

It is an object of the present invention to provide a pile changing device for the delivery of a sheet fed press which is triggered upon achievement of a full pile and which accomplishes its function rapidly, smoothly and reliably in a series of automatic programmed steps. It is a related object to provide a pile changing device which includes automatic means for interposing an auxiliary intercepting pile board but in which a full skid is removed and an empty one is substituted in such quick succession that relatively few sheets are deposited on the auxiliary board even when the press is continuously operated at high speed.

It is a more specific object to provide an automatic pile changing device which is capable of operating under complete automatic control, removing a full pile and substituting an empty board, without care or attention on the part of the pressman and indeed without requiring a pressman to be in atendance. This is to be contrasted with prior manual changing procedures which have involved careful timing, exercise of a high degree of skill and experience and expenditure of a good deal of manual effort. Since the pressman is freed from any need even to keep watch on the height of the pile, his time and effort may be utilized for more productive purposes.

It is a further specific object to provide an automatic pile changer which employs a fork type lift mechanism, carriage-supported, and which is programmed to undergo a novel cycle of horizontal, vertical and swinging movements to achieve transfer in a minimum of time and with a minimum amount of shifting of the carriage. In this connection it is an object to provide a pile changer which makes use of conventional skids, which is universally usable with all sheet deliveries and regardless of press speed, which does not require any modification of existing portions of a conventional delivery mechanism and which is inherently economical and compact.

Other objects and advantages of the invention will become apparent upon reading the attached detailed description and upon reference to the drawings in which.

Figures 1, 2, 2A:
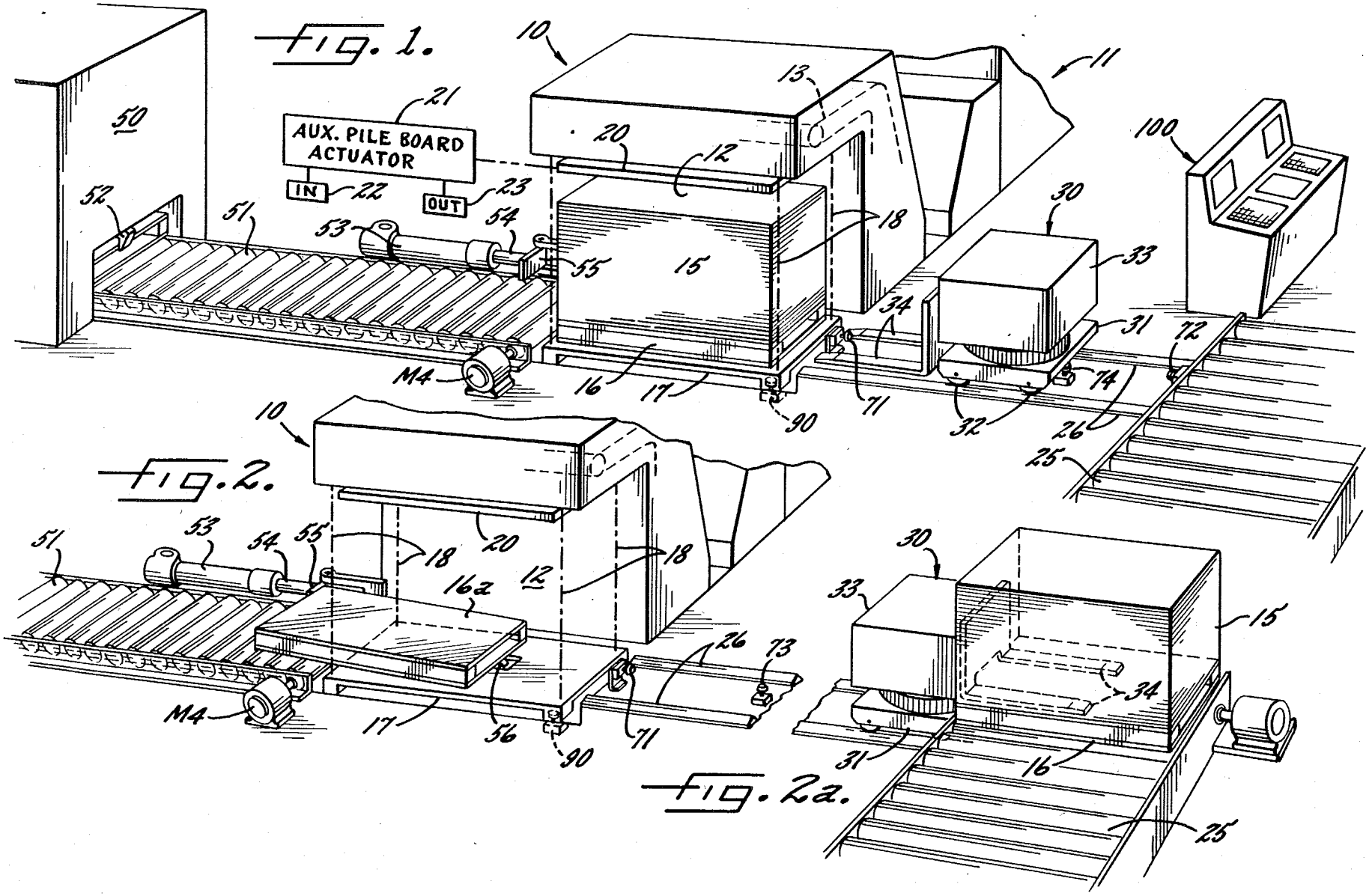
FIG. 1 is a somewhat schematic perspective drawing of a pile changing device constructed in accordance with the invention and integrated with the delivery of a sheet fed printing press in readiness for picking up a full skid.
FIG. 2 is a perspectiveview showing substitution of an empty skid.

FIG. 2*a* shows the subsequent depositing of the full skid on the discharge conveyor.

Figure 3:
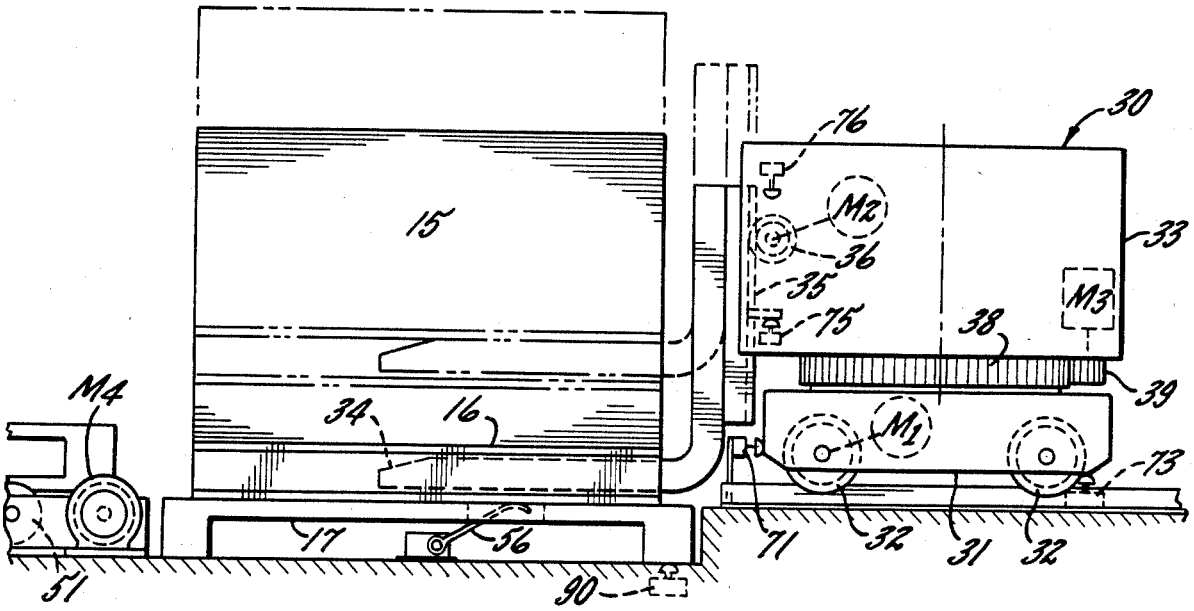

FIG. 3 is a fragmentary front elevational view showing the fork lift device lifting a full skid.

Figure 4:
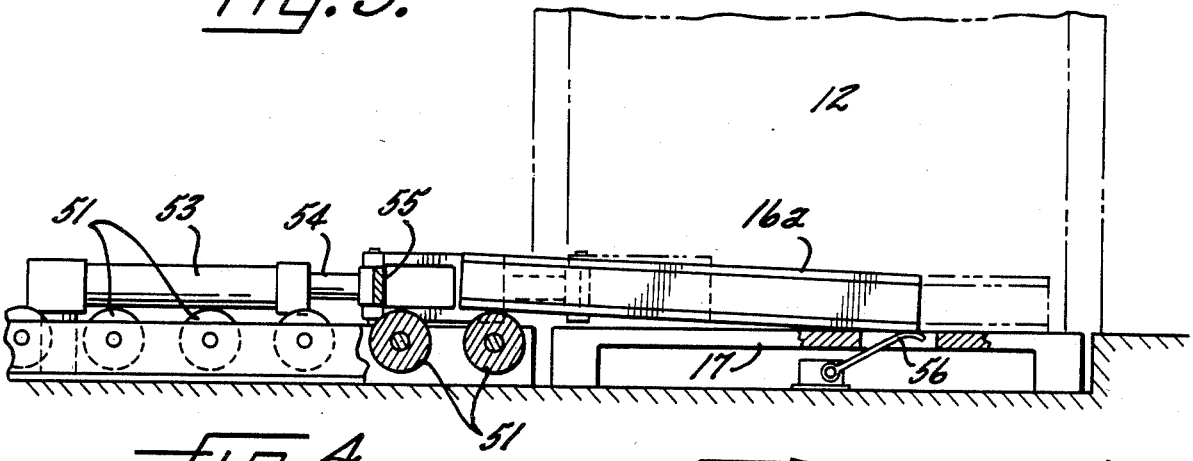

FIG. 4 is a similar view showing substitution of an empty skid.

Figure 5:
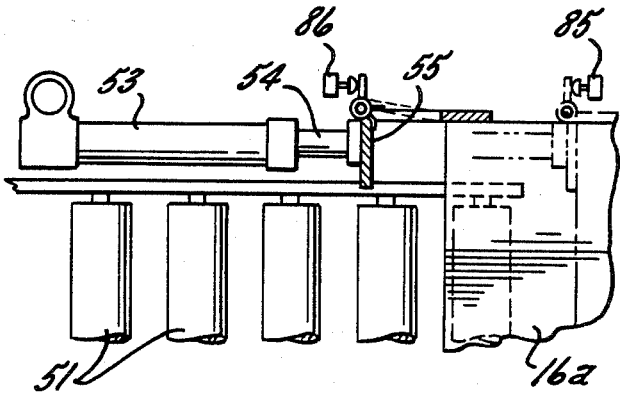

FIG. 5 is a fragmentary plan view showing the locator cylinder.

Figure 6:
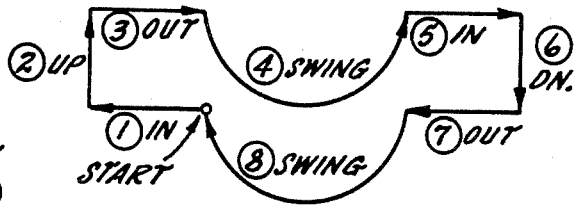
Figure 8:
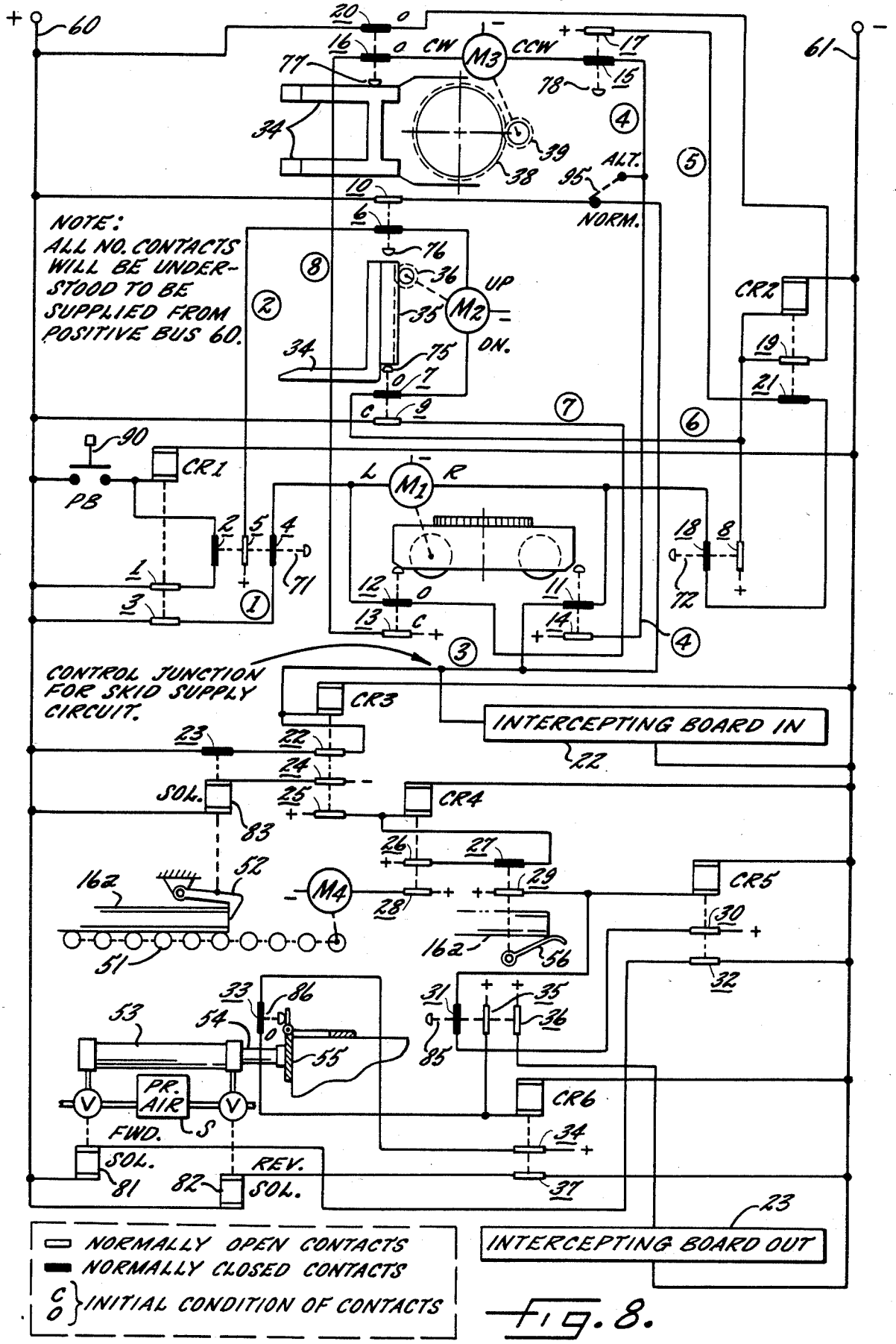

FIG. 6 is a sequence diagram showing fork movement and which is keyed to the wiring diagram of FIG. 8.

Figure 7:
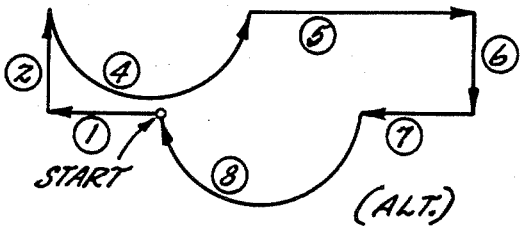

FIG. 7 shows a modified program of fork movement.

FIG. 8 is a schematic diagram for the control circuitry.

While the invention has been described in connection with certain preferred embodiments, it will be understood that we do not intend to be limited to the particular embodiments shown but intend, on the contrary, to cover the alternative and equivalent constructions included within the spirit and scope of the appended claims.

Referring to FIGS. 1–4 there is shown a delivery mechanism 10, which is usually referred to simply as the "delivery" of the printing press 11 which will be assumed to be of the sheet-fed type and having a piling space 12 into which sheets are delivered by means of a sheet conveyor 13. The sheet conveyor is per se conventional; it will suffice to say that the conveyor is provided with grippers (not shown) which grip the sheet at the leading edge, with the grippers being triggered for release of the sheet in the piling space where the sheet settles, by gravity, upon a pile 15. The pile 15 is supported upon a pile board in the form of a skid 16 which is supported upon a platform 17 suspended by chains 18. Again, the means 17, 18 for supporting the pile is conventional and reference may be made to prior German patent for additional details.

In conventional operation of a delivery 10 and press 11 the sheets are gradually accumulated until the pile board is "full". The press is then either slowed down or stopped entirely while the pile board is manually substituted. If the press is allowed to continue in operation, means are provided for intercepting the sheets which are received during the interval of the substitution. Such means is generally in the form of an auxiliary pile board 20 which is interposed, and subsequently withdrawn, by an actuating mechanism shown schematically at 21. The particular construction of the auxiliary pile board 20, its mounting and the actuator 21 which operates the board are per se known in the art and may, for example, be constructed as shown in U.S. prior Pat. No. 3,477,710 and as disclosed in such patent, the board 20 is so constructed that when it is withdrawn the intercepted sheets are automatically deposited on the empty pile board to begin a new pile. It will be assumed that the actuator 21 is capable of response to "board in" and "board out" signals as schematically indicated at 22, 23 respectively.

In accordance with the present invention a second conveyor, spaced from the piling space, is provided with a track extending therebetween. A fork lift mechanism is mounted on the track and provided with control means for directing the fork lift mechanism to remove the full skid from the piling space and to deposit it on the second conveyor. In addition a skid magazine is provided including mechanism activated by the control means for prompt feeding, and conveying, of an empty skid from the magazine to take the place of the one which has been removed. An auxiliary intercepting pile board also actuated by the control means is temporarily interposed in the path of the delivered sheets during the brief interval when there is no skid in the sheet-receiving position. Finally, means are provided for initiating operation of the control means, and thereby starting a transfer cycle, automatically in response to the achievement of a full skid in the piling space.

Referring again to the drawings, the second conveyor for receiving the full skid from the piling space and for transporting it out of the press area substantially at floor level is indicated at 25. Such conveyor is per se constructed and operated in accordance with known techniques and need not be described in detail. Extending substantially at floor level between the piling space and the second conveyor, and arranged substantially at right angles to the latter, is a track 26. Riding on the track is a fork lift mechanism 30. The mechanism includes a carriage 31 riding upon wheels 32 which are driven by a reversible motor M1. Supported on the carriage 31 is a frame 33 which mounts a fork 34. The fork 34 is preferably slidable upon vertical ways having an associated rack 35. The rack is positioned by a pinion 36 driven by a reversible motor M2. For the purpose of swinging the frame 33 and the fork 34 which is secured to it about a vertical axis 37, the frame preferably has a ring gear 38 driven by a pinion 39 which is coupled to a reversible motor M3.

In a typical transfer sequence of the fork lift mechanism there may be a total of eight separate steps as diagrammed in FIG. 6. First the fork lift mechanism is shifted to the left so that the fork moves into the piling space and under the skid. Secondly, the fork is lifted. Thirdly, the fork, carrying the skid, is retracted. Fourthly, the fork is rotated 180° so that it faces the second conveyor. Fifthly, it is moved onto the conveyor and sixthly, lowered. Seventhly, the fork is retracted and, eighthly, and finally, swung back to its initial position. The second conveyor 25, now bearing the load, may then be manually or automatically actuated to remove the full skid from the press area.

In carrying out the invention a source of empty skids is provided in the form of a skid magazine 50 (FIG. 1) having an associated "third" conveyor 51 extending from the magazine to the piling space, substantially at floor level the conveyor being driven by a motor M4. Means are provided, preferably in the form of a latch 52 or equivalent, for feeding an empty skid, indicated at 16*a*, from the magazine so that it is conveyed by the conveyor to the vicinity of the piling space. Means are provided for then accurately positioning the empty skid in receiving position. Such means includes a pneumatic actuator 53 having a plunger 54 carrying a lug 55. The lug 55 is freely swingable in the forward direction and spring biased rearwardly so that it may yield to let the skid pass by before assuming a pushing condition. Operation of the actuator 53 is under the control of a wiper 56 which responds to the arrival of the empty skid in the piling space, as will be described.

Reference will next be made to the control diagram which is set forth schematically in FIG. 8. The diagram consists primarily of limit switches and relays shown associated with the mechanical elements which control or actuate them. The contacts of the limit switches and relays are shown in stylized fashion for the sake of simplicity, normally open contacts being indicated by white rectangles while normally closed contacts are indicated by black rectangles, the rectangles being associated by dotted lines with their associated plunger or relay armature. The circuits from all of the normally open contacts will be understood to be supplied from the positive bus 60.

In the initial state the contacts will be understood to be in their normal conditions except where the contrary is indicated by use of "o" (for open) and "c" (for closed). The contacts are designated by underlined, that is to say italicized, reference numerals in the order of actuation or pertinence.

Referring first to the limit switches associated with the fork lift carriage 31, there are left and right-hand limit switches 71, 72 at the extreme limits of carriage movement. Intermediate left and right-hand limit switches 73, 74 define a central or home position for the carriage. In the initial state the contacts 12, 13 of the intermediate limit switch 73 are open and closed, respectively, the carriage having most recently moved from right to left, with leftward movement being stopped by the opening of contact 12.

Similarly the fork 34 is provided with limit switches 75, 76 which are actuated at the respective limits of downward and upward motion. It will be assumed at the outset that the fork 34 has most recently been lowered until contact has been broken by the normally closed contact 7; hence this contact is indicated as open, with its associated normally open contact 9 being initially in the closed state.

Turning attention next to the upper portion of FIG. 8, the limits of swinging movement in the left and right-hand directions is determined by limit switches 77, 78, respectively. Here again it will be assumed that in the initial state the contacts of limit switch 77 are in their opposite, or open, condition by reason of the fact that the fork has most recently swung from right to the leftward-pointing position illustrated in FIGS. 1, 3 and 8.

Prior to a review of the control sequence, the other components of the control diagram will be briefly mentioned: A total of six control relays designated CR-1 to CR-6 are employed. Two solenoid valves of the three-way type are used as indicated at 81, 82, also a latch solenoid 83 for actuating the latch 52. Limit switches 85, 86 are located at the respective limits of outward and inward movement of the plunger 54 of actuator 53, the normally closed contact 33 of switch 86 being in the open condition with the plunger initially in the retracted state. In order to make the diagram more easily understood, and the sequence more easily followed, the encircled numerals designate lines which, when energized by the contacts with which they are associated, initiate a corresponding function in the fork movement diagram, FIG. 6.

For the purpose of initiating the control sequence, a switch 90 is provided which is automatically actuated upon achievement of full pile height. Such a switch may be located in the path of downward movement of the platform 17 on which the pile is stacked. Thus it will be understood that, as is conventional in printing press deliveries, gradual accumulation of sheets in the stack is accompanied by gradual downward movement of the supporting platform until the switch 90 is closed. The switch 90, as a matter of convenience in the present circuit, is so constructed that a single momentary pulse is produced when the switch is actuated by the platform.

In a typical cycle of operation the following sequence occurs: Pulsing of the relay CR-1 by the switch 90 closes contact 1 via contact 2, temporarily sealing in the relay. Closure of contact 3 through contact 4 energizes the carriage motor M1 driving the carriage to the left and causing the fork to enter the skid. (It will be assumed in the discussions which follows that the track length, and the spacing of the limit switches 71–74, are such as to accommodate the sequence set forth.) Leftword movement is halted by engagement of the carriage with limit switch 71, opening contact 4 and turning off the carriage motor. At the same time contact 2 opens dropping out relay CR-1. Also at the same time, contact 5 closes which, via contact 6 energizes the fork lift motor M2 to raise the fork, thereby lifting the skid from the platform 17 in readiness for withdrawal (FIG. 3).

At the upper limit of fork movement, limit switch 76 is actuated, opening contact 6 to cut off further movement and contact 10 is closed which accomplishes three different functions: In the first place closure of contact 10 energizes, via contact 11, the carriage motor M1 in the rightward direction. Secondly, closure of contact 10 actuates control 22, interposing the intercepting board 20. Finally, closure of contact 10 energizes relay CR-3 which initiates feeding of an empty skid from the magazine 50. The feeding sequence is carried out by the separate portion of the control circuit shown in the lower half of FIG. 8 which will be discussed subsequently. It will suffice to say, for the present, that as soon as the fork carriage is given the instruction to retract, an empty skid is liberated to move into position thereby reducing the time interval during which no skid is in receiving position.

As the carriage 31 moves to the right into its centered position it engages the limit switch 74 which opens contact 11 cutting off flow of current to the carriage motor M1 so the carriage stops. At the same time contact 14 closes and, via contact 15, energizes the fork swivel motor M3 so that it begins to rotate counterclockwise, the pile of sheets on the fork swinging from left to right so that it faces the conveyor 25. At this point limit switch 78 is actuated, opening contact 15 to cut off further flow of current to motor M3. Contact 17 closes which, via contacts 21 and 18 energizes the carriage motor M1 for additional movement in the right-hand direction. This movement continues until limit switch 72 is operated which opens contact 18 cutting off further current to the motor M1. Contact 8 closes, completing a circuit through contact 7 to erengize fork lift motor M2 for downward movement of the fork. At the same time relay CR-2 is energized, the relay sealing itself in through its contact 19 via normally closed contact 20 which is, at this point, in closed condition. As the fork reaches its lowermost condition, thereby lowering the skid onto the conveyor 25, contact 7 opens, deenergizing motor M2 to terminate the lowering movement. At the same time closure of contact 9, through contact 12, energizes the carriage motor M1 for leftward movement.

Thus the fork backs away leaving the skid deposited upon the conveyor 25. As the carriage reaches its central position, it engages limit switch 73 opening contact 12 to stop further movement. Contact 13 closes which, via normally closed contact 16 energizes the swing motor M3, causing it to swing the fork in the clockwise direction until limit switch 77 is engaged after 180 degrees of swing. At this point contact 16 opens deenergizing the motor M3 and thereby restoring the fork mechanism to its initial condition. At the same time contact 20 is opened dropping out relay CR-2.

The above paragraphs describe a complete cycle of movement of the fork mechanism. However, it will be recalled that early in such cycle, specifically at the step ③ at the beginning of the retraction of the full skid from the piling space, two additional functions were triggered by the circuit; first, the interposition of the auxiliary pile board 20 and secondly the releasing of the latch 52 which initiates feeding of an empty skid from the magazine 50. This is accomplished by energization of the relay CR-3 closing contacts 22, 24 and 25. Closure of contact 22 temporarily seals in the relay through normally closed contact 23. Closure of contact 24 energizes solenoid 83 which picks up the latch 52, releasing the empty pile board **16*a* so that it may be conveyed by the conveyor 51. Closure of contact 25 energizes relay CR-4 which seals itself in through its normally open contact 26 via normally closed contact 27. At the same time closure of contact 28 energizes the conveyor motor M4 to convey the empty skid along the conveyor and toward the piling space. The conveyor continues to rotate until the wiper arm 56 is actuated by the leading edge of the empty skid, opening contact 27 and dropping out relay CR-4 which turns the conveyor motor off. At the same time closure of contact 29 energizes relay CR-5. Closure of contact 30 thereon, via contact 31, seals in the relay. The wiper arm contacts may be of the momentary impulse type. Closure of contact 32 energizes solenoid valve 81 to admit pressurized air from the source S to the left-hand end of the actuator 53 causing the plunger 54 to stroke forwardly to its dot-dash position, thereby advancing the empty skid into a receiving position in the piling space. For most precise positioning a duplicate actuator assembly, in mirror image, may be provided on the other lateral side of the skid. As the plunger 54 reaches the right-hand end of its stroke, it engages limit switch 85 opening contact 31, droping out relay CR-5, turning off the valve 81 and venting the actuator. Contact 35 closes energizing relay CR-6 and contact 36 closes energizing control 23** to cause retraction of the auxiliary pile board.

The energization of relay CR-6 closes contact 34 which, through a circuit including contact 33, seals in the relay. At the same time, closure of contact 37 energizes the retract solenoid valve 82 to supply air from the source S in a direction to retract the plunger 54. Retraction of the plunger upon engagement of the limit switch 86 opens contact 33, thereby dropping out relay CR-6 to complete a skid substitution cycle. Sheets now begin to accumulate on the new pile board, or skid, **16*a* until the pile board is full, whereupon the switch 90** is again actuated to trigger a completely new substitution cycle.

While the cycle just described includes all eight of the steps illustrated in FIG. 6 including step ③ which is the retraction of the full skid from the piling space prior to swinging movement, the invention is not necessarily limited to this and, in the case of a true "open front" delivery where there is no impediment to outward swing the full pile board may be swung directly out of the piling space in accordance with step ④ without the preliminary retraction of step ③. This possibility is illustrated in FIG. 7 where it will be noted that a sequence goes directly from lifting, step ②, to swinging, step ④. This bypassing of step ③ is symbolically accomplished by making a direct connection, as indicated by the switch shown dot-dash at 95 from contact 10 of limit switch 76 to contact 15 of limit switch 78.

While it is a feature of the invention in its preferred form that the sequence is initiated automatically, without necessity for any action on the part of the operator, when the pile grows to the desired height, the invention may also be practiced by substituting a manual pushbutton in place of the triggering switch 90, a pushbutton which may, for example, be incorporated in the control console 100. Or, if desired, a manual pushbutton may be arranged in parallel with the triggering switch, thereby making it possible for an unloading cycle to be initiated even when there is less than a full pile on the skid in the piling space.

It will be apparent that the objects of the invention have been amply carried out. Instead of having to stop or slow the press, the press continues to operate at normal speed during the skid removal and substitution. The operation takes place automatically and in synchronized fashion without intervention by the operator, and the hiatus, when no skid is in receiving position, is so brief that only a minimum of sheets need be intercepted by the auxiliary pile board. The tension and strain normally associated with pile board removal in a high speed press is completely eliminated so that the press may be safely attended by a pressman of only limited skill or experience.

While the term "board" has been used to describe the intercepting device it will be understood that this is a term of art not limited to use of a rigid receiving surface. Similarly the term "skid" refers to any member capable of accumulating a pile of sheets and which is removable from the piling space. The term "second conveyor" is intended to be a general term to cover any means for receiving a full skid for subsequent transportation from the press area. The term "magazine" refers to any source of empty skids and from which skids may be fed one by one. The term "at floor level" means the level of the floor shown in the drawings, particularlythe level of the floor surrounding the delivery mechanism 10 and the press 11 which supplies it. The track 26 and conveyors 25, 52, referred to as being "substantially at floor level", are all at a level within the reasonable vicinity of the floor, shown in the drawings as being a matter of inches of the floor, in easy reach within the limited vertical range of a lift fork 34. Finally the term "track" is a term not necessarily limited to steel rails but referring more generally to any means for guiding or supporting the fork lift mechanism in its path of movement.

What we claim is:

1. In a printing press delivery mechanism the combination comprising a first conveyor for delivering sheets from a press for discharge seriatim onto a pile in a piling space, a pile board in the form of a skid in the piling space for accumulating the pile, a second horizontally extending conveyor at substantially floor level a short distance from the piling space for receiving the skid when it is full, a horizontally extending track extending substantially at floor level between the piling space and the second conveyor and arranged substantially at right angles to the latter, a wheeled carriage on the track, a lift fork on the carriage, powered rotating means supporting the fork on the carriage for swinging movement through substantially 180 degrees from a loading position in which the fork faces the piling space and an unloading position in which the fork faces the second conveyor, powered lifting means for raising and lowering the fork with respect to the carriage, powered driving means for reciprocating the carriage along the track, programmed control means including limit switches for energizing the powered means in sequence for a cycle of skid removal in which the fork is (a) shifted from an initial position by the carriage into the pile space to engage the skid, (b) raised so the skid clears the floor, (c) rotated 180 degrees with the skid so that it points in the direction of the second conveyor, (d) shifted by the carriage to a position in which the skid is over the second conveyor, (e) lowered to lower the skid onto the second conveyor for transfer out of the delivery area, and (f) returned to the initial position, a skid magazine for empty skids, means including a third conveyor horizontally extending from the magazine to the piling space for feeding an empty skid from the magazine to the piling space substantially at floor level, means actuated incident to the arrival of the empty skid for locating the same in a sheet receivingposition in the piling space, means initiated by the control means for actuating the feeding means so that an empty skid is fed from the magazine into receiving position synchronized with the removal of the full skid therefrom, and means responsive to the filling up of the empty skid for triggering the control means for a successive cycle of skid removal.

* * * * *

UNITED STATES PATENT AND TRADEMARK OFFICE

CERTIFICATE OF CORRECTION

PATENT NO. : 4,565,129

DATED : January 21, 1986

INVENTOR(S) : Claus Simeth

It is certified that error appears in the above-identified patent and that said Letters Patent is hereby corrected as shown below:

In the title of the Patent, after "PRINTING" insert --PRESS--.

Signed and Sealed this

*First* Day of *April 1986*

[SEAL]

*Attest:*

DONALD J. QUIGG

*Attesting Officer*

*Commissioner of Patents and Trademarks*